United States Patent [19]

Haywood

[11] 4,068,316

[45] Jan. 17, 1978

[54] CONVERTIBLE SHIRT

[75] Inventor: Jay L. Haywood, Clancey, Mont.

[73] Assignee: The Raymond Lee Organization, Inc., New York, N.Y. ; a part interest

[21] Appl. No.: 762,458

[22] Filed: Jan. 25, 1977

[51] Int. Cl.[2] ..... A41B 1/08

[52] U.S. Cl. ..... 2/126

[58] Field of Search ..... 2/126, 269

[56] References Cited

U.S. PATENT DOCUMENTS 2,104,826 1/1938 Stramiello ..... 2/126

FOREIGN PATENT DOCUMENTS 608,323 9/1948 United Kingdom ..... 2/126

*Primary Examiner*—Werner H. Schroeder
*Assistant Examiner*—Doris L. Troutman
*Attorney, Agent, or Firm*—Daniel Jay Tick

[57] ABSTRACT

A pair of long sleeves of a shirt are severed above the elbow to provide short sleeves extending from the shirt and a pair of arm covering parts independent therefrom. The arm covering parts are zipped to the short sleeves by zippers which are covered by inner flaps to prevent contact between the zipper and the arm and outer flaps to hide the zippers.

2 Claims, 3 Drawing Figures

CONVERTIBLE SHIRT

BACKGROUND OF THE INVENTION

The present invention relates to a convertible shirt.

Objects of the invention are to provide a convertible shirt of simple structure, which is inexpensive in manufacture, converted with facility, convenience and rapidity from a longsleeved shirt to a short-sleeved shirt, and vice versa, and functions efficiently, effectively and reliably as two completely different types of shirt, as desired.

BRIEF DESCRIPTION OF THE DRAWINGS

In order that the invention may be readily carried into effect, it will now be described with reference to the accompanying drawings, wherein.

Figure 1:
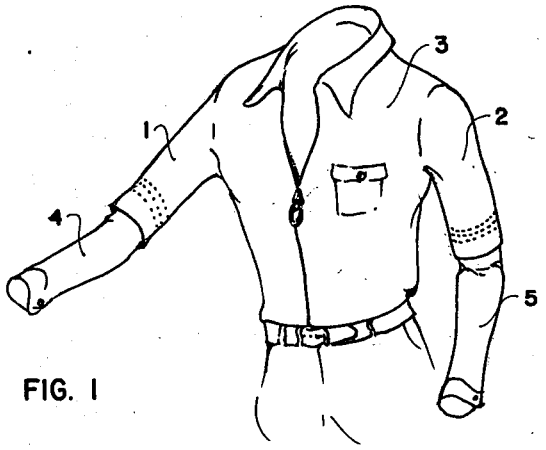
FIG. 1 is a view of an embodiment of the convertible shirt of the invention in its long-sleeved form.
Figure 2:
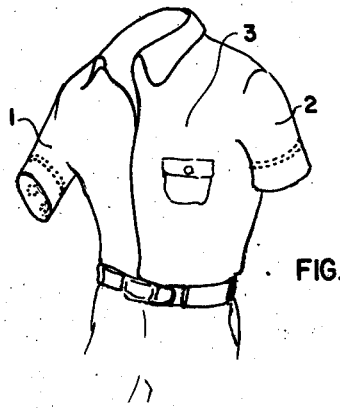
FIG. 2 is a view of the embodiment of FIG. 1 in its short-sleeved form.

DETAILED DESCRIPTION OF THE INVENTION:

The convertible shirt of the invention comprises a pair of long sleeves each severed above the elbow whereby a pair of short sleeves 1 and 2 extend from a shirt 3, as shown in FIGS. 1 and 2, and a pair of arm covering parts 4 and 5 (FIG. 1) are independent from the short sleeves.

Figure 3:
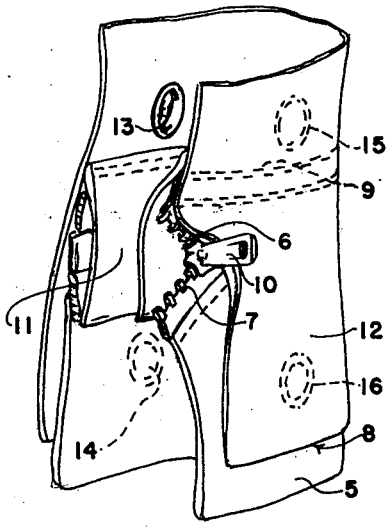
FIG. 3 is a perspective view, on an enlarged scale, partly cut away, of an embodiment of a zipper and flaps of one of the sleeves of the convertible shirt of the invention.

A pair of zippers are provided, each for a corresponding one of the arms. As shown in FIG. 3, each of the zippers has a pair of cooperating tooth strips 6 and 7. The tooth strip 6 of the zipper is affixed to the inside of the short sleeve 2 of the shirt in the area of the severed edge 8 thereof. The tooth strip 7 is affixed to the arm covering part 5 in the area of the severed edge 9 thereof.

Thus, the zipper 10 releasably affixes the arm covering part 5 to the short sleeve 2 so that when the zipper is zipped the shirt is long-sleeved and when the zipper is unzipped the shirt is short-sleeved. The other zipper (not shown in the FIGS.) releasably affixes the arm covering part 4 to the shirt sleeve 1 in the same manner.

A pair of inner flaps are provided. Each flap is affixed to the inside of a corresponding one of the short sleeves 1 and 2. Thus, as shown in FIG. 3, the inner flap 11 is affixed to the inside of the short sleeve 2 and extends between the zipper 10 and the arm of the wearer, thereby preventing the skin of the wearer from being caught in the zipper.

Each one of the short sleeves 1 and 2 extends beyond the zipper for affixing it to the corresponding one of the arm covering parts 4 and 5, thereby functioning as outer flaps to hide the zippers. Thus, as shown in FIG. 3, the extending part 12 of the short sleeve is provided and covers the zipper 10 of said short sleeve and the arm covering part 5.

Releasable snap fasteners 13 and 14, and 15 and 16 are affixed to the short sleeve 2 at distances from each other for releasably affixing said short sleeve to itself, in an inside cuff, over the zipper 10, when the shirt is worn as a short-sleeved shirt, as shown in FIG. 2. Releasable snap fasteners (not shown is the FIGS.) are affixed to the short sleeve 1 in the same manner as the fasteners 13 and 14, and 15 and 16.

A single releasable snap fastener 13 of this group of snaap fasteners is shown in FIG. 3.

While the invention has been described by means of a specific example and in a specific embodiment, I do not wish to be limited thereto, for obvious modifications will occur to those skilled in the art without departing from the spirit and scope of the invention.

I claim:

1. A convertible shirt, comprising a pair of long sleeves each severed above the elbow whereby a pair of short sleeves extend from the shirt and a pair of arm covering parts are independent therefrom;

a pair of zippers each having a pair of cooperating tooth strips one of which is affixed to the inside of a corresponding one of the short sleeves in the area of the severed edge thereof and the other of which is affixed to a corresponding one of the arm covering parts in the area of the severed edge thereof whereby each of the zippers releasably affixes a corresponding one of the arm covering parts to a corresponding one of the short sleeves whereby when the zippers are zipped the shirt is longsleeved and when the zippers are unzipped the shirt is shortsleeved, each of the short sleeves extending beyond the zipper thereof;

a pair of flaps each affixed to the inside of a corresponding one of the short sleeves and extending between the corresponding one of the zippers and the arm of a wearer; and releasable fastening means affixed to the short sleeves in spaced relation with each other for forming inside cuffs for releasably covering each of the zippers when the short sleeves are the extremities of the shirt.

2. A convertible shirt as claimed in claim 1, wherein the fastening means comprises snap fasteners.

* * * * *